US006893364B1

(12) United States Patent
Grunfeld

(10) Patent No.: US 6,893,364 B1
(45) Date of Patent: May 17, 2005

(54) PORTABLE FLAT-FACED INTERACTIVE TRAINING SOCCER GOAL

(76) Inventor: Dan Grunfeld, 1360 Bellaire St., Denver, CO (US) 80220

( * ) Notice: Subject to any disclaimer, the term of this patent is extended or adjusted under 35 U.S.C. 154(b) by 42 days.

(21) Appl. No.: 10/300,264

(22) Filed: Nov. 19, 2002

Related U.S. Application Data

(63) Continuation-in-part of application No. 09/844,502, filed on Apr. 27, 2001, now abandoned.

(51) Int. Cl.[7] ..... A63B 69/00; A63B 63/00; E04H 15/34

(52) U.S. Cl. ..... 473/446; 473/422; 473/476; 473/478; 473/197; 135/121

(58) Field of Search ..... 473/422, 446, 473/197, 490–495, 470, 471, 478, 477; 273/400, 273/407, 408, 410, 348; 135/115, 118, 119, 135/907, 913, 117; 139/24, 422; D21/699, D21/705, 704

(56) References Cited

U.S. PATENT DOCUMENTS

| | | | | |
|---|---|---|---|---|
| 2,155,209 | A * | 4/1939 | Walker | 5/415 |
| 2,195,895 | A * | 4/1940 | Moore | 139/384 B |
| 3,195,898 | A * | 7/1965 | Respini | 473/197 |
| 3,685,549 | A * | 8/1972 | Goff et al. | 139/24 |
| 4,003,181 | A * | 1/1977 | Robinson et al. | 135/115 |
| 4,083,561 | A * | 4/1978 | Daffer, Jr. | 473/432 |
| 4,116,446 | A * | 9/1978 | Thompson | 473/197 |
| 4,127,272 | A * | 11/1978 | Pennell | 473/478 |
| 4,258,923 | A * | 3/1981 | Senoh | 473/478 |
| 4,921,257 | A * | 5/1990 | Heller | 473/446 |
| 5,048,844 | A * | 9/1991 | Haseltine | 273/400 |
| 5,080,375 | A * | 1/1992 | Moosavi | 473/478 |
| 5,308,083 | A * | 5/1994 | Grunfeld et al. | 273/400 |
| 5,316,314 | A * | 5/1994 | Wilson | 273/400 |
| 5,580,064 | A * | 12/1996 | Childers, Jr. | 273/400 |
| 5,730,442 | A * | 3/1998 | Anderson | 273/400 |
| 5,791,363 | A * | 8/1998 | Moses | 135/143 |
| 5,816,956 | A * | 10/1998 | Ellis et al. | 473/490 |
| 6,264,570 | B1 * | 7/2001 | Yoon | 473/197 |
| 6,530,844 | B2 * | 3/2003 | Lin | 473/197 |

FOREIGN PATENT DOCUMENTS

FR 2612863 A1 * 9/1988

* cited by examiner

*Primary Examiner*—Mitra Aryanpour
(74) *Attorney, Agent, or Firm*—Edwin H. Crabtree; Ramon L. Pizarro; Donald W. Margolis

(57) ABSTRACT

A flat-faced interactive training soccer goal used for soccer practice. The soccer goal has a goal frame held in compression and a net and web frame held in tension for increased rebounding of a soccer ball. The flat-faced soccer goal includes a goal frame made up of a plurality of metal tube sections joined together by plurality of connector sleeves and a pair of corner elbow sleeves for forming a pair of upright posts and a horizontal crossbar. A top portion of the upright posts is joined to opposite ends of the crossbar using the corner elbow sleeves. The corner elbow sleeves are bent at an angle greater than 90 degrees and upward to 110 degrees for forming a trapezoid configuration with the crossbar being parallel to the ground surface. The upright posts are disposed outwardly and at an angle from the vertical. When the goal frame is installed, the upright posts are moved inwardly into a vertical position for forming a rectangular configuration.

16 Claims, 2 Drawing Sheets

PORTABLE FLAT-FACED INTERACTIVE TRAINING SOCCER GOAL

This application is a continuation-in-part application of an application filed on Apr. 27, 2001, Ser. No. 09/844,502 now abandoned, having a title of "METHOD AND APPARATUS FOR PORTABLE FLAT FACED REBOUNDING SOCCER TRAINING GOAL" and by the subject inventor, Dan Grunfeld.

BACKGROUND OF THE INVENTION (a) Field of the Invention

This invention relates to soccer goals and more particularly, but not by way of limitation, to a portable flat-faced interactive training soccer goal having a goal frame held in compression and a net held in tension. The net can include a combination of stretch and non-stretch webbing making up a webbing frame. The flat-faced soccer goal is used for practice and training.

(b) Discussion of Prior Art

Heretofore, there have been a variety of different types of portable training goals and practice goals. In U.S. Pat. No. 4,083,561 to Daffer a soccer practice goal is disclosed. In U.S. Pat. No. 4,116,446 to Thompson a game net support apparatus is described. In U.S. Pat. Nos. 4,127,272 to Pennell and 4,407,507 to Caruso, two different types of portable soccer goals are illustrated. In U.S. Pat. No. 4,258,923 to Senoh. a soccer football goal structure is described. In U.S. Pat. No. 5,048,844 to Haseltine, a flat-faced portable rebounding soccer training goal is shown.

In U.S. Pat. No. 5,308,083 to the subject inventor, a traditional soccer goal is disclosed and having a rebounding net for returning a ball struck into the net. The goal includes a frame formed by a horizontal crossbar and a pair of vertical posts secured to the ground by a pair of base supports. Struts are used to support the vertical posts. A sleeve is used to join the net to the horizontal crossbar of the frame. The net and a mainstay cord are secured by hooks to the base supports. When the struts are spread outwardly, tension on the net is increased to provide sufficient rebound when a ball is struck into the net.

None of the above mentioned prior art patents specifically disclose the unique features, structure and function of the subject flat-faced soccer goal having a portable goal frame made up of tube sections and connector sleeves held in compression and a net with a web frame having a combination of stretch and non-stretch webbing or just non-stretch webbing alone making up the web frame.

SUMMARY OF THE INVENTION

In view of the foregoing, it is a primary objective of the subject invention to provide a flat-faced rebounding training soccer goal having increased tension on the net for rapid return of a soccer ball back to a kicker after the ball has been struck into the net.

Another key object of the invention is to provide soccer players with a greatly improved soccer goal that helps hone follow-up shots.

Still another object of the invention is the flat-faced soccer goal helps maximize the efficiency of practice drills by simulating a traditional soccer goal but will quickly rebound the ball. In this manner, a player can take a series of rapid-fire shots on the goal and/or take a power shot on the goal and immediately follow through with a rebounding shot after the first shot is deflected back out of the goal.

A further object of the invention is the net is attached to a web frame. The web frame is interspersed with both non-stretch webbing and stretch webbing. The combination of the stretch and non-stretch web frame provides increased tension on the net, when attached to the soccer goal frame, for improved rebounding and with a modest increase in net cost.

Still a further object and important feature of the invention is the soccer goal frame is erected using tube sections and connector sleeves that are compressed together when two upright posts that are attached to opposite ends of a horizontal crossbar are moved inwardly from a trapezoidal configuration with the ground surface to a rectangular configuration with the ground surface and inserted into ground engaging post bases. The bending and compression of the upright posts prevents the tube sections and sleeves, making up the horizontal crossbar and the posts, from coming loose or being jarred loose during the use of the goal. Also, the compression of the goal frame greatly increases the strength and rigidity of the frame when the net and web frame are secured thereon.

Yet another object of the flat-faced portable soccer goal is the goal is portable, lightweight, roughed in construction and can be quickly and easily setup for soccer practice and training. Obviously by design, the flat-faced soccer goal can be used for soccer practice on both sides of the net.

The flat-faced soccer goal includes a goal frame made up of a plurality of metal tube sections joined together by plurality of connector sleeves and a pair of corner elbow sleeves for forming a pair of upright posts and a horizontal crossbar. A top portion of the upright posts is joined to opposite ends of the crossbar using the corner elbow sleeves. The corner elbow sleeves are bent at an angle greater than 90 degrees and upward to 110 degrees thus forming a trapezoid configuration with the crossbar being parallel to the ground surface. The upright posts are disposed outwardly and at an angle from the vertical. When the goal frame is installed, the upright posts are moved inwardly into a perpendicular position with respect to the ground and parallel to each other for forming a rectangular configuration with the ground surface. The movement of the upright posts into a perpendicular position provides a bending movement or torque on the tube sections and connector sleeves thereby compressing them together in a lock fit and preventing the goal frame from coming loose or being disassembled during use. A soccer goal net having a web frame is attached to the horizontal crossbar and the upright posts. The web frame can include non-stretch webbing or a combination of non-stretch webbing and stretch webbing for increased tension on the net.

These and other objects of the present invention will become apparent to those familiar with various types of flat-faced soccer goals, soccer goal nets and web frames when reviewing the following detailed description, showing novel construction, combination, and elements as herein described, and more particularly defined by the claims, it being understood that changes in the embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments in the present invention according to the best modes presently devised for the practical application of the principles thereof, and in which.

DETAILED DESCRIPTION OF THE PREFERRED EMBODIMENTS

Figure 1:
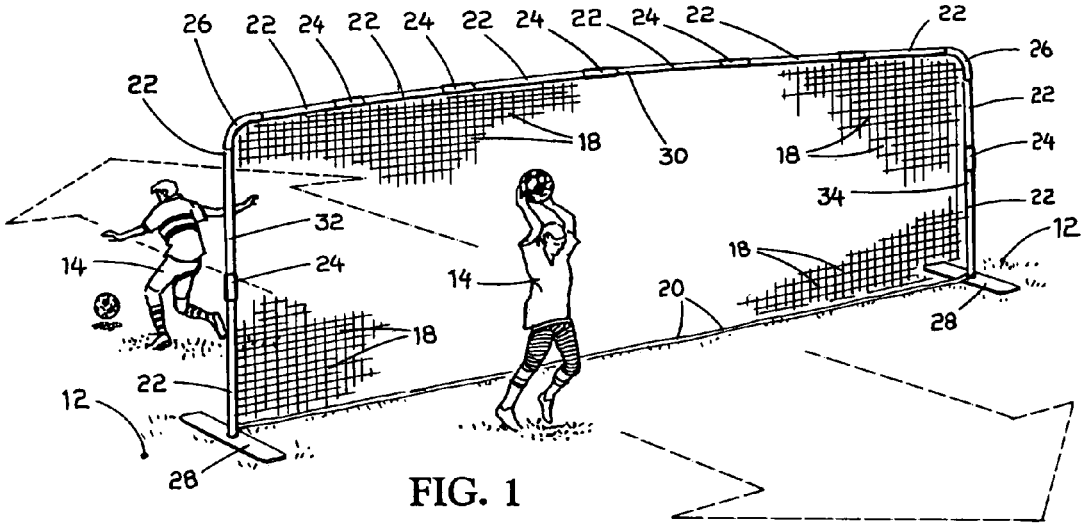
FIG. 1 is a perspective view of the subject portable flat-faced interactive soccer goal fully assembled and installed vertically on a portion of a ground surface making up a playing field. A pair of soccer players are shown in action on both sides of the soccer goal.

In FIG. 1, a perspective view of the subject portable flat-faced interactive soccer goal is shown and having general reference numeral 10. The goal 10 is illustrated fully assembled and installed vertically on a portion of a ground surface 12 making up a playing field. A pair of soccer players 14 are shown in action on both sides of the flat-faced soccer goal 10.

Broadly, the soccer goal 10 includes a goal frame, having general reference numeral 16, for holding in tension a soccer goal net 18 with a web frame 20 attached to a perimeter of the net. The web frame 20 is shown in greater detail in FIGS. 4–6. The goal frame 16 includes a plurality of metal tube sections 22, a plurality of connecting sleeves 24, a pair of corner elbow sleeves 26 and a pair of ground engaging post bases 28.

When assembling the goal frame 16, tube sections 22, having a length of approximately 43 inches, are connected together using five connecting sleeves 24, having a length of approximately 13 inches, to form a horizontal crossbar 30. The dimension of the tube sections and sleeves, when connected together, provide a standard width of a soccer goal, which is typically 24 feet. Also, the goal frame 16 uses two tube sections 22 connected to a connector sleeve 24 to form a first upright post 32 and a second upright post 34. A standard height of a soccer goal is typically 8 feet. A top portion of the upright posts 32 and 34 is connected to the corner elbow sleeves 26. Opposite ends of the crossbar 30 are also connected to the elbow sleeves 26. A bottom portion of the upright posts 32 and 34 is attached to the top of the ground engaging post bases 28, which hold the soccer goal 10 upright and in a vertical position as shown in this drawing.

Figure 2A:
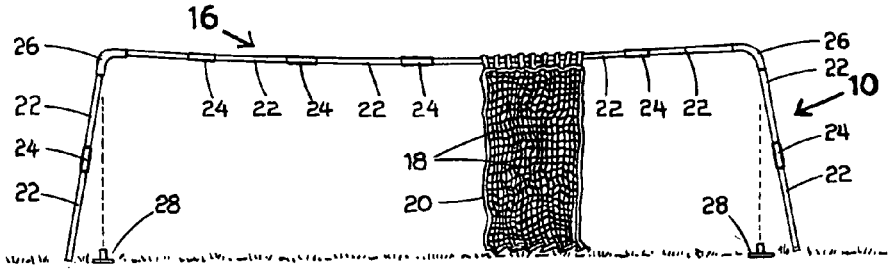
FIG. 2A is a front view of a soccer goal frame illustrating an upper portion of a pair of upright posts attached to opposite ends of a horizontal crossbar. The goal frame is shown having a trapezoid configuration with the ground surface, with the upright posts extending outwardly and at an angle from the vertical. The goal frame is shown prior to securing the upright posts to ground engaging post bases. Also, a soccer goal net and a web frame attached to a perimeter of the net are shown gathered together prior to positioning the net and the web frame next to the length of the crossbar and upright posts.

In FIG. 2A, a front view of the soccer goal frame 16 is shown with the upright posts 32 and 34 attached to opposite ends of the crossbar 30. The goal frame 16 is shown having a trapezoid configuration with the crossbar 30 parallel to the ground surface 12. The bottom portion of the upright posts 32 and 34 is shown extending outwardly, due to the angle of the corner elbow sleeves 26, and at an angle from the vertical. The goal frame 16 is shown prior to securing the upright posts 32 and 34 to the ground engaging post bases 28. The post bases 28, shown in the drawing, are spaced apart the same distance as the length of the crossbar 30 or 24 feet.

The soccer goal net 18 and web frame 20 are shown suspended from the crossbar 30 and gathered together prior to positioning the net 18 and web frame 20 next to the length of the crossbar 30 and the length upright posts 32 and 34. It should be mentioned, that due to the weight of the crossbar 30 and the weight of the gathered net 18 and web frame 20, the crossbar 30 drapes slightly downward from the horizontal.

Figure 2B:
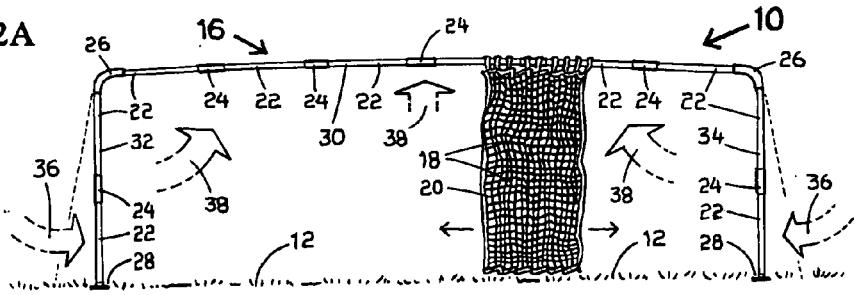
FIG. 2B is a front view of the soccer goal frame with the upright posts moved inwardly into a vertical position and forming a rectangular configuration with the ground surface. A bottom portion of the upright posts is secured to the ground surface using the ground engaging post bases. The goal frame is now installed properly in an upright and vertical position on the ground surface and prior to spreading the net and web frame along the lengths of the crossbar and upright posts as shown in FIG. 1.

In FIG. 2B, a front view of the soccer goal frame 16 is illustrated with the upright posts 32 and 34 moved inwardly into a perpendicular position with the ground surface 12 and attached to the top of the ground engaging post bases 28. The frame now has a rectangular configuration with the crossbar 30 parallel to the ground surface 12. Also, the first post 32 is parallel to the second post 34. The goal frame 16 is now installed properly in an upright and vertical position on the ground surface 12. Also, the goal frame 16 is now ready for spreading the net 18 and web frame 20 along the length of the crossbar 30 and the length of the posts 32 and 34, as shown in FIG. 1.

It is important to note, as the upright posts 32 and 34 are moved inwardly into a vertical position, as indicated by arrows 36, the tube sections 22 and connector sleeves 24 are placed in compression, as indicated by arrows 38. Also note, that as the frame 16 is compressed, the center of the crossbar is bowed slightly upward and above the horizontal. The compression of the frame 16 comes about by a bending moment or torque placed thereon by the inward movement of the upright posts 32 and 34. The tube sections 22 and sleeves 24 are now locked together in place thus preventing movement and accidental disassembly of the frame 16, when the soccer goal 10 is in use.

Figure 3A:
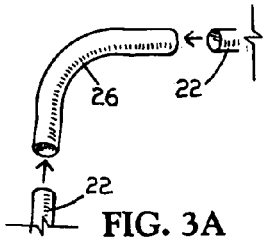
FIG. 3A is a perspective view of one of a pair of corner elbow sleeves positioned to receive one end of a tube section used with the crossbar and one end of another tube section used with one of the upright posts.

In FIG. 3A, a perspective view of one of the corner elbow sleeves 26 is shown positioned to receive one end of a tube section 22 used with the crossbar 30 and one end of another tube section 22 used with the first upright post 32.

Figure 3B:
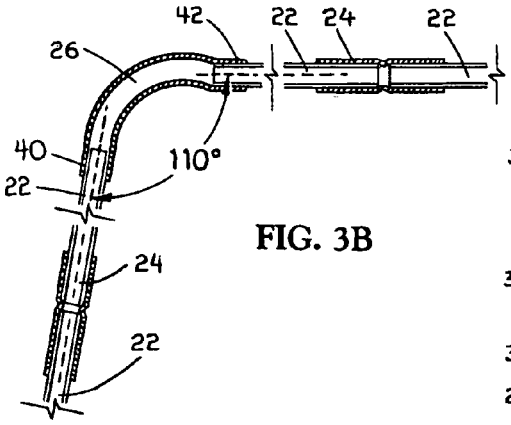
FIG. 3B is a side sectional view of the corner elbow sleeve and the ends of the tube sections, shown in FIG. 3A, inserted into the ends of the elbow sleeve. A lower arm of the corner elbow sleeve is shown bent outwardly at an angle of up to approximately 110 degrees from a horizontal arm of the elbow sleeve.

In FIG. 3B, a side sectional view of the corner elbow sleeve 26 is shown with the ends of the tube sections 26, shown in FIG. 3A, inserted into the ends of the elbow sleeve 26. A lower arm 40 of the corner elbow sleeve 26 is shown bent outwardly at an angle of up approximately 110 degrees from a horizontal arm 42 of the elbow sleeve 26.

Figure 3C:
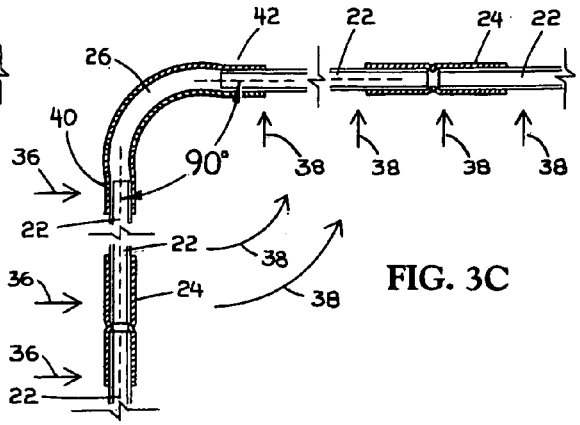
FIG. 3C is another side sectional view of the corner elbow sleeve shown in FIG. 3B with the lower arm of the corner elbow sleeve and a tube section of the upright post moved inwardly with the lower arm of the elbow sleeve now at 90 degrees from the horizontal arm of the elbow sleeve.

In FIG. 3C, another side sectional view of the corner elbow sleeve is shown as seen in FIG. 3B. In this drawing, the lower arm 40 of the corner elbow sleeve 26 and a tube section 22 of the first upright post 32 is moved inwardly, as indicated by arrows 36, with the lower arm 40 now at 90 degrees from the horizontal arm 42 of the elbow sleeve 26. As mentioned above, the bending moment applied to both of the elbow sleeves 26 in turn places the goal frame 16 in compression for increased strength and rigidity.

Figure 4:
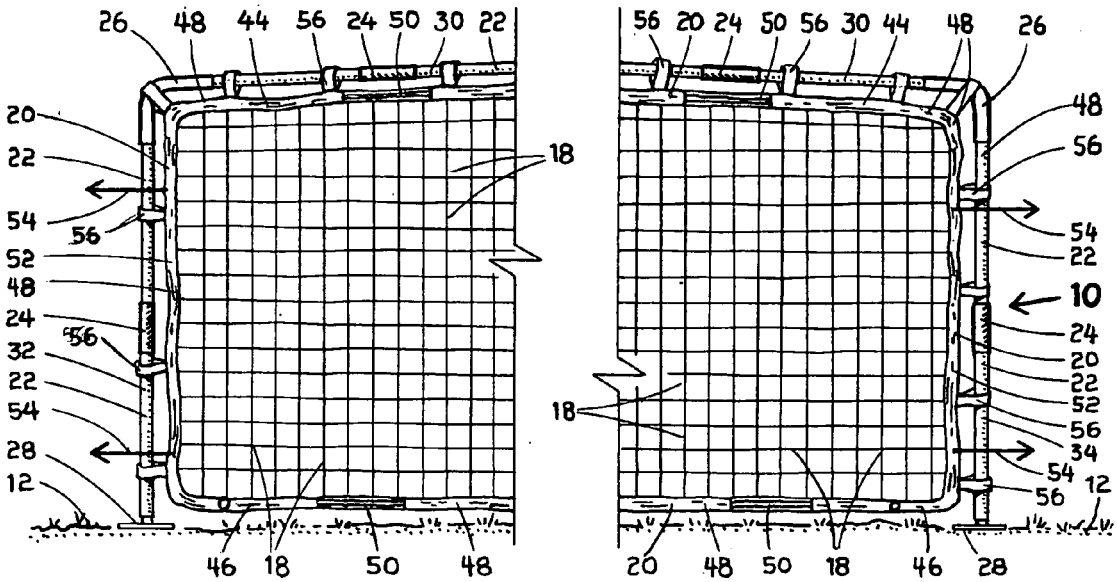
FIG. 4 is a front view of a portion of the portable flat-faced soccer goal with a soccer goal net and web frame attached to the side the crossbar and the sides of the two upright posts. The web frame is shown made up of non-stretch webbing material and sections of stretch webbing material for increase tension on the net.

In FIG. 4, a front view of a portion of the portable flat-faced soccer goal 10 is shown with the soccer goal net 18 and the web frame 20 spread out and attached along the length of the crossbar 30 and along the length of the two upright posts 32 and 34. In this drawing, an upper horizontal portion 44 of the web frame 20 and a lower horizontal portion 46 of the web frame include sections of non-stretch webbing 48 and sections of stretch webbing 50 for increase tension on the net 18. It should be mentioned, that vertical portions 52 of the web frame 20 are made of the non-stretch webbing 48, since it has been found that the net 18 and web frame 20 need not be stretched in a vertical direction.

Typically, a web frame with nylon net is stretched tightly on the goal frame. But, while the nylon net is able to be stretched taut, by the nature of the material used in a non-stretch webbing, the web frame does not stretch sufficient for improving desired rebound qualities of a flat-faced soccer goal. With this in mind, the subject web frame 20 includes two spaced apart sections of stretch webbing 50 in the upper horizontal portion 44 and two spaced apart sections of stretch webbing 50 in the lower horizontal portion 46 of the web frame 20. This allows for an additional stretching of the net up to 8 inches along the horizontal. The added stretching or tension on the net 18 and web frame 20 is shown as arrows 54. The stretch webbing 50 can vary in length from 8 inches to 15 inches and is typically approximately 12 inches in length. In this drawing, the sides of the web frame 20 include loop straps 56 for holding the web frame next to the sides of the crossbar 30 and the upright posts 32 and 34.

As mentioned above, the feature of having the web frame 20 interspersed with both non-stretch webbing 48 and stretch webbing 50 provides for increased tension 54 on the net 18 and web frame 20 for improved rebounding on the soccer goal 10. Stretch webbing 50 costs a great deal more than non-stretch webbing 48. But because only small amounts of stretch webbing 50 are required when compared to the overall length of non-stretch webbing 48 used in making the web frame 20, the overall increased cost is modest. Also, it has been found that interspersing additional stretch webbing into the web frame is not necessary for any further added benefits to the features of the soccer goal.

Figure 5:
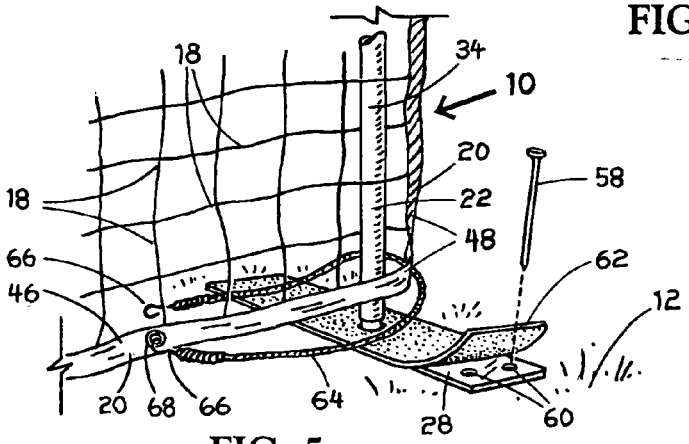
FIG. 5 is a perspective view of a lower portion of the goal frame and one of the ground engaging post bases. The net is shown with a web frame made up of non-stretch webbing material and a burgee cord used for holding down a lower portion of the net next to the ground surface.

In FIG. 5, a perspective view of a lower portion of the goal frame 10 is shown with one of the ground engaging post bases 28 being installed on the ground surface 12. The base 28 includes four large spikes 58, which are driven through holes 60 in opposite ends of the base 28 and into the ground. By driving the spikes 54 into the ground and at an angle from the vertical, the four spikes 54 hold the soccer goal 10 firmly on top of the ground surface 12. The post bases 28 also include a protective cover 62 received over the top of the spikes 54. When the spikes are driven into the ground, the cover 62 helps prevent injury to a player should the player step or fall on top of the post base 28.

Also, the net 18 and web frame 20 are shown with a bungee cord 64 having hooks 66 in opposite ends for engaging a grommet 68 in the lower horizontal portion 46 of the web frame 20. The use of the bungee cord 64 helps hold the bottom of the net 18 close to the ground surface 12 and prevents soccer balls from scooting under the net. Also shown in the drawing is the net 18 and net spaces weaved in and out of the second upright post 34 for securing the net 18 and web frame 20 to the sides of the upright posts 32 and 34 and the crossbar 30. Obviously, the net and web can be secured to the goal frame 16 by weaving the net in and out as shown in this drawing or loop straps 56 can be used as shown in FIG. 4 or any other soccer net securing means can be used equally well.

The net 18, in this drawing, is shown with the web frame 20 made up entirely of the non-stretch webbing 48. While certain users of the soccer goal 10 prefer a high performance net 18 and web frame 20 with increased tension as shown in FIG. 4, other users may prefer a more standard net with web frame made of non-stretch webbing 48 and having minimal rebound bounce off the net as shown in FIG. 5.

Figure 6:
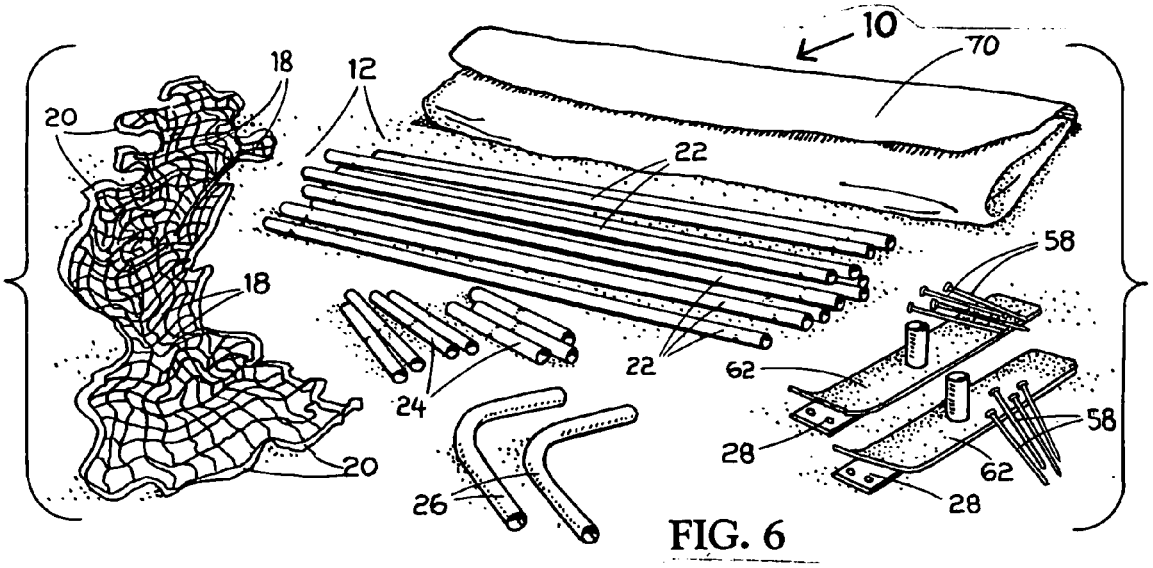
FIG. 6 is a perspective view of the individual components making up the portable flat-faced soccer goal shown in FIGS. 1–5 and including a carrying bag for transporting the soccer goal when it is disassembled as shown in this drawings.

In FIG. 6, a perspective view of the individual components is shown and making up the portable flat-faced soccer goal 10. The components being the tube sections 22, the connecting sleeves 24, the two corner elbow sleeves 26, the net 18 and web frame 20 and the two ground engaging post bases 28 for holding the goal frame 18 upright. Also and because the soccer goal 10 is portable, a soccer goal carrying bag 70 can be included for transporting the soccer goal when it is disassembled as shown in this drawing. While the dimensions of the tube sections 22 and connecting sleeves 24 are discussed for forming a standard soccer goal having a length of 24 feet and a height of 8 feet, it should be mentioned that various sizes of portable flat-faced soccer goals can be made equally well with different lengths of tube sections 22 and without departing from the spirit and scope of the invention.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed except as precluded by the prior art.

The embodiments of the invention for which as exclusive privilege and property right is claimed are defined as follows:

1. A portable flat-faced interactive training soccer goal used for soccer practice and training and mounting on a ground surface of a playing field, the soccer goal comprising:

a goal frame, said goal frame including a substantially horizontal crossbar and first and second upright posts, an upper portion of said first upright post attached to one end of said crossbar, an upper portion of said second upright post attached to an opposite end of said crossbar, said first and second upright posts extending outwardly at an angle greater than 90 degrees and upward to 110 degrees from said horizontal crossbar, said first and second upright posts and said horizontal crossbar adapted for forming a first position of a trapezoid configuration when held upright and prior to being secured to the ground surface; and a soccer goal net attached to a web frame, said web frame attached to sides of said crossbar and sides of said first and second upright posts;

whereby said first and second upright posts are adapted for moving inwardly and at an angle of 90 degrees from said horizontal crossbar when a lower portion of said first and second upright posts is secured to the ground surface and forming a second position of a rectangular configuration, said goal frame is held in compression for increase strength and rigidity, said horizontal crossbar bowed slightly upward above the horizontal when held in compression for preventing a bottom of said net from dragging on the ground surface.

2. The soccer goal as described in claim 1 wherein said horizontal crossbar is made up of a plurality of tube sections connected together using a plurality of connecting sleeves.

3. The soccer goal as described in claim 1 wherein said first and second upright posts are made up of a plurality of tube sections connected together using a plurality of connecting sleeves.

4. The soccer goal as described in claim 1 wherein the upper portion of said first and second upright posts are attached to opposite ends of said horizontal crossbar using a pair of corner elbow sleeves.

5. The soccer goal as described in claim 4 wherein said elbow sleeves include a horizontal arm and a lower arm, said lower arm bent at an angle greater than 90 degrees and upward to 110 degrees from said horizontal arm.

6. The soccer goal as described in claim 5 wherein said lower arm is bent at an angle of approximately 110 degrees from said horizontal arm of said elbow sleeves.

7. The soccer goal as described in claim 1 wherein said goal frame includes a pair of ground engaging post bases attached to a lower portion of said first and second upright posts and adapted for holding said goal frame upright on the ground surface.

8. The soccer goal as described in claim 1 wherein said web frame includes a combination of stretch and non-stretch webbing for increasing tension on said net and said web frame when attached along a length of said crossbar and when attached along a length of said first and second upright posts.

9. The soccer goal as described in claim 1 wherein said web frame includes an upper horizontal portion, a lower horizontal portion and two vertical portions, said vertical portions made of non-stretch webbing, said upper and lower horizontal portions including sections of non-stretch webbing and sections of stretch webbing.

10. The soccer goal as described in claim 1 wherein said web frame includes an upper horizontal portion and a lower horizontal portion made of non-stretch webbing, said web frame also having two vertical portions made of non-stretch webbing.

11. A portable flat-faced interactive training soccer goal used for soccer practice and training and mounting on a ground surface of a playing field, the soccer goal comprising:

a goal frame, said goal frame including a substantially horizontal crossbar and first and second upright posts, said crossbar made up of a plurality of tube sections connected together using a plurality of connecting sleeves, said first and second upright posts made up of a plurality of tube sections connected together using a plurality of connecting sleeves, an upper portion of said first upright post attached to one end of said crossbar using a corner elbow sleeve, an upper portion of said second upright post attached to an opposite end of said crossbar using another corner elbow sleeve, said first and second upright posts extending outwardly at an angle greater than 90 degrees and upward to 110 degrees from said horizontal crossbar, said first and second upright posts and said horizontal crossbar adapted for forming a first position of a trapezoid configuration when held upright and prior to securing to the ground surface; and a soccer goal net attached to a web frame, said web frame attached to and disposed around a periphery of said net, said web frame attached to sides of said crossbar and sides of said first and second upright posts;

whereby said first and second upright posts are adapted for moving inwardly and at an angle of 90 degrees from said horizontal crossbar when a lower portion of said first and second upright posts is secured to the ground surface and forming a second position of a rectangular configuration, said goal frame is held in compression for increase strength and rigidity, said horizontal crossbar bowed slightly upward above the horizontal when held in compression for preventing a bottom of said net from dragging on the ground surface.

12. The soccer goal as described in claim 11 wherein said elbow sleeves include a horizontal arm and a lower arm, said lower arm bent at an angle of approximately 110 degrees from said horizontal arm.

13. The soccer goal as described in claim 11 wherein said goal frame includes a pair of ground engaging post bases with a protective cover thereon and a plurality spikes adapted for securing said post bases to the ground surface, the lower portion of said first and second upright posts secured to a top of said post bases, said post bases adapted for holding said goal frame upright on the ground surface.

14. The soccer goal as described in claim 11 wherein said web frame includes an upper horizontal portion, a lower horizontal portion and two vertical portions, said vertical portions made of non-stretch webbing, said upper and lower horizontal portions including sections of non-stretch webbing and sections of stretch webbing, said sections of stretch webbing having a length in a range of 8 to 15 inches.

15. The soccer goal as described in claim 11 wherein said web frame includes an upper horizontal portion and a lower horizontal portion made of non-stretch webbing, said web frame also having two vertical portions made of non-stretch webbing.

16. A portable flat-faced interactive training soccer goal used for soccer practice and training and mounting on a ground surface of a playing field, the soccer goal comprising:

a goal frame, said goal frame including a substantially horizontal crossbar and first and second upright posts, an upper portion of said first upright post attached to one end of said crossbar, an upper portion of said second upright post attached to an opposite end of said crossbar;

a soccer goal net; and a web frame, said web frame attached to a periphery of said net, said web frame releaseably attached to sides of said crossbar and sides of said first and second upright posts, said web frame having a combination of stretch and non-stretch webbing for increasing tension on said net and said web frame when attached along a length of said crossbar and when attached along a length of said first and second upright posts, said web frame having an upper horizontal portion, a lower horizontal portion and two vertical portions, said vertical portions made of non-stretch webbing, said upper and lower horizontal portions including sections of non-stretch webbing and sections of stretch webbing for applying tension horizontally on said net and said web frame, said sections of stretch webbing have a length in a range of 8 to 15 inches.

* * * * *